US011482372B2

(12) United States Patent
Yang et al.

(10) Patent No.: US 11,482,372 B2
(45) Date of Patent: Oct. 25, 2022

(54) COIL COMPONENT

(71) Applicant: SAMSUNG ELECTRO-MECHANICS CO., LTD., Suwon-si (KR)

(72) Inventors: Ju Hwan Yang, Suwon-si (KR); Chang Hak Choi, Suwon-si (KR); Byeong Cheol Moon, Suwon-si (KR); Yong Hui Li, Suwon-si (KR); Byung Soo Kang, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 311 days.

(21) Appl. No.: 16/869,934

(22) Filed: May 8, 2020

(65) Prior Publication Data

US 2021/0183561 A1 Jun. 17, 2021

(30) Foreign Application Priority Data

Dec. 13, 2019 (KR) ..... 10-2019-0166808

(51) Int. Cl.
*H01F 27/28* (2006.01)
*H01F 41/04* (2006.01)
(Continued)

(52) U.S. Cl.
CPC ..... *H01F 27/2804* (2013.01); *H01F 27/24* (2013.01); *H01F 27/29* (2013.01); *H01F 41/041* (2013.01); *H01F 2027/2809* (2013.01)

(58) Field of Classification Search
CPC ..... H01F 27/2804; H01F 27/28; H01F 27/24; H01F 27/29; H01F 41/041; H01F 2027/2809; H01F 41/04
See application file for complete search history.

(56) References Cited

U.S. PATENT DOCUMENTS

2015/0048915 A1 2/2015 Yoon et al.
2017/0178798 A1 6/2017 Yoon et al.
2018/0033540 A1 2/2018 Lee et al.

FOREIGN PATENT DOCUMENTS

CN 106898479 A 6/2017
CN 107658095 A 2/2018
(Continued)

OTHER PUBLICATIONS

Office Action issued in corresponding Korean Patent Application No. 10-2019-0166808 dated Oct. 21, 2020, with English translation.
(Continued)

*Primary Examiner* — Robert L Deberadinis
(74) *Attorney, Agent, or Firm* — Morgan, Lewis & Bockius LLP

(57) ABSTRACT

A coil component includes a body embedding a support substrate, an external electrode disposed on one surface of the body, and a coil portion disposed on the support substrate and including a lead-out pattern having one surface exposed to one end surface of the body abutting the one surface of the body. A connection electrode penetrates the lead-out pattern, extends to the external electrode, and has one surface exposed to the one end surface of the body. An intermetallic compound is disposed between the connection electrode and the lead-out pattern. The connection electrode includes a base resin, a plurality of metal particles disposed in the base resin, and a conductive connection portion surrounding the plurality of metal particles and in contact with the intermetallic compound.

19 Claims, 4 Drawing Sheets

(51) Int. Cl.
*H01F 27/24* (2006.01)
*H01F 27/29* (2006.01)

(56) References Cited

FOREIGN PATENT DOCUMENTS

| | | | |
|---|---|---|---|
| JP | 2002-289463 | A | 10/2002 |
| KR | 10-2007-0075867 | A | 7/2007 |
| KR | 10-2015-0019730 | A | 2/2015 |
| KR | 10-2018-0053620 | A | 5/2018 |

OTHER PUBLICATIONS

Chinese Office Action dated Jul. 5, 2022, issued in corresponding Chinese Patent Application No. 202010696434.5.

COIL COMPONENT

CROSS-REFERENCE TO RELATED APPLICATION(S)

This application claims benefit of priority to Korean Patent Application No. 10-2019-0166808 filed on Dec. 13, 2019 in the Korean Intellectual Property Office, the disclosure of which is incorporated herein by reference in its entirety.

BACKGROUND

1. Field

The present disclosure relates to a coil component.

2. Description of Related Art

An inductor, a coil component, is a representative passive electronic component used in electronic devices together with a resistor and a capacitor.

In the case of a thin film type coil component, a coil pattern may be formed on an insulating substrate by a thin film process such as a plating process, a body may be formed by layering one or more magnetic composite sheets on the insulating substrate on which the coil pattern is formed, and an external electrode may be formed on a surface of the body. Generally, both end portions of the coil pattern may be exposed to respective end surfaces of the body opposing each other in a length direction of the body, and external electrodes may be configured to protrude to both end surfaces of the body to be electrically connected to both end portions of the coil pattern.

In this case, a length of the body against an overall length of the component may be reduced (e.g., reduced by thicknesses of the external electrodes on both end surfaces), and an effective volume of a magnetic material may be reduced with reference to an overall area of the component.

SUMMARY

An aspect of the present disclosure is to provide a coil component which may have improved component properties by increasing an effective volume of a magnetic material.

Another aspect of the present disclosure is to provide a coil component which may have improved component properties by reducing contact resistance between a lead-out pattern and a connection electrode.

According to an aspect of the present disclosure, a coil component includes a body embedding a support substrate therein, an external electrode disposed on one surface of the body, a coil portion disposed on the support substrate and including a lead-out pattern having one surface exposed to one end surface of the body abutting the one surface of the body, a connection electrode penetrating the lead-out pattern, extending to the external electrode, and having one surface exposed to the one end surface of the body, and an intermetallic compound disposed between the connection electrode and the lead-out pattern. The connection electrode includes a base resin, a plurality of metal particles disposed in the base resin, and a conductive connection portion surrounding the plurality of metal particles and in contact with the intermetallic compound.

According to another aspect of the present disclosure, a coil component includes a body having one surface and another surface opposing each other, and first and second end surfaces connecting the one surface and the other surface to each other and opposing each other. A support substrate is embedded in the body, and a coil portion is disposed on the support substrate and includes first and second lead-out patterns respectively exposed to the first and second end surfaces of the body. First and second connection electrodes each include a base resin, a plurality of metal particles disposed in the base resin, and a conductive connection portion surrounding the plurality of metal particles, the first and second connection electrodes each extending from the one surface of the body to the other surface of the body, respectively penetrating the first and second lead-out patterns, each penetrating the support substrate, and each having one surface exposed to a respective one of the first and second end surfaces of the body. An intermetallic compound is disposed between the first connection electrode and the first lead-out pattern and between the second connection electrode and the second lead-out pattern, and is in contact with and connected to the conductive connection portion of the corresponding connection electrode of the first and second connection electrodes.

According to a further aspect of the present disclosure, a coil component includes a body having a planar end surface, and a coil portion embedded in the body and including a coil pattern embedded in the body and a lead-out pattern extending from the coil pattern to be exposed to the planar end surface of the body. A connection electrode penetrates the body and the lead-out pattern, and has one surface exposed to the planar end surface of the body across a full height of the planar end surface of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
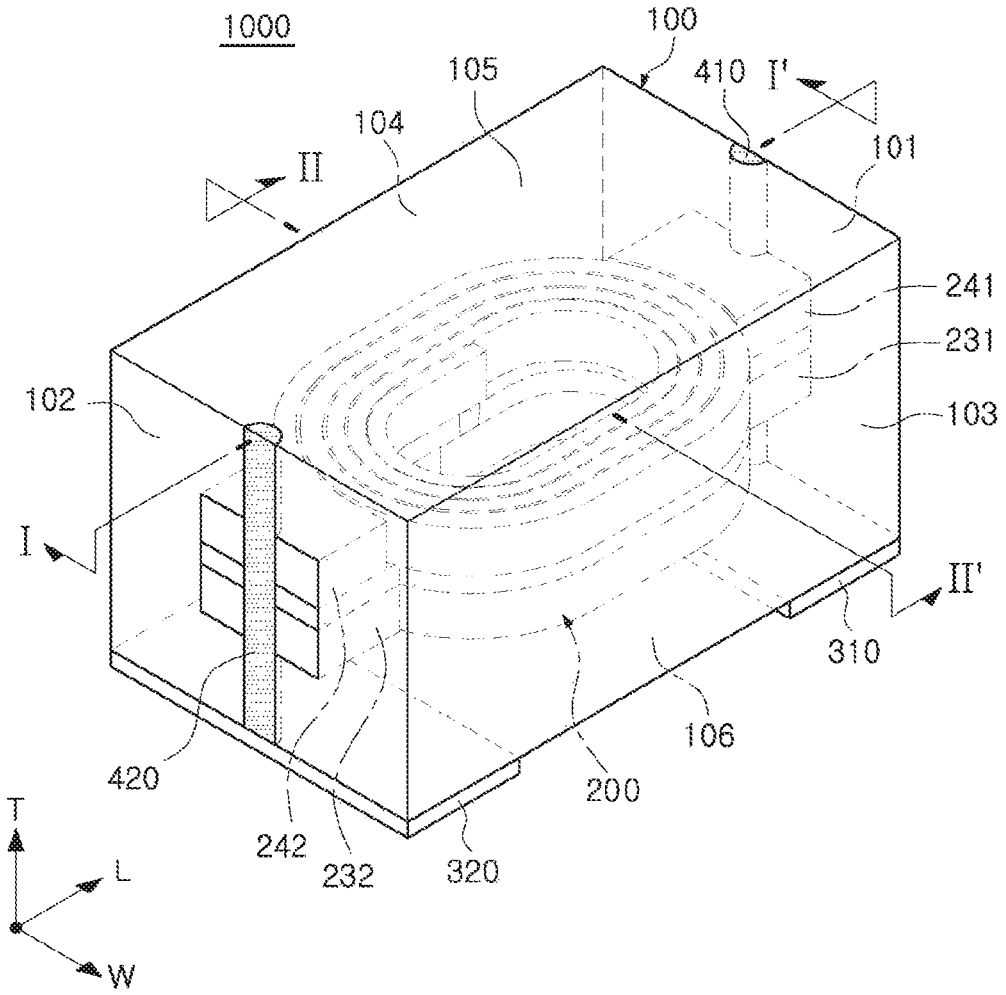
FIG. 1 is a perspective diagram illustrating a coil component according to an example embodiment of the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or beneath an object, and does not necessarily mean that the element is positioned on the object with reference to a gravity direction.

The term "coupled to," "combined to," and the like, may not only indicate that elements are directly and physically in contact with each other, but also include the configuration in which another component is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, and a T direction is a third direction or a thickness direction.

In the descriptions of the accompanying drawings, the same elements or elements corresponding to each other will be described using the same reference numerals, and overlapped descriptions will not be repeated.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

FIRST EXAMPLE EMBODIMENT

Figure 2:
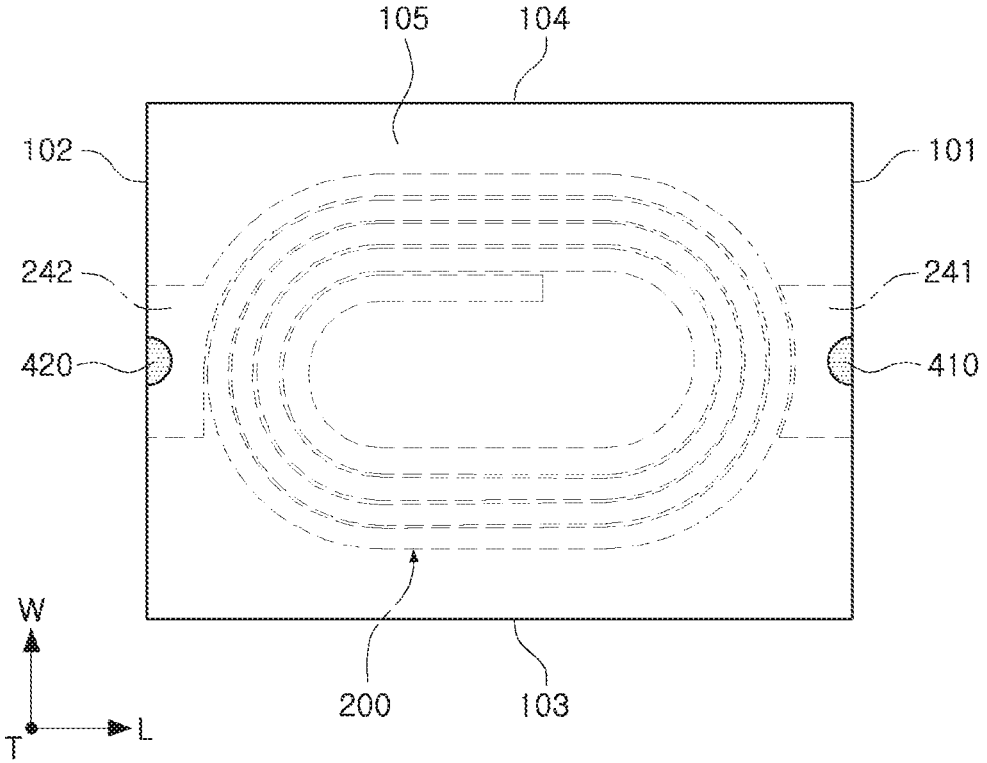
FIG. 2 is a diagram illustrating a coil component viewed from an upper portion thereof according to an example embodiment of the present disclosure.
Figure 3:
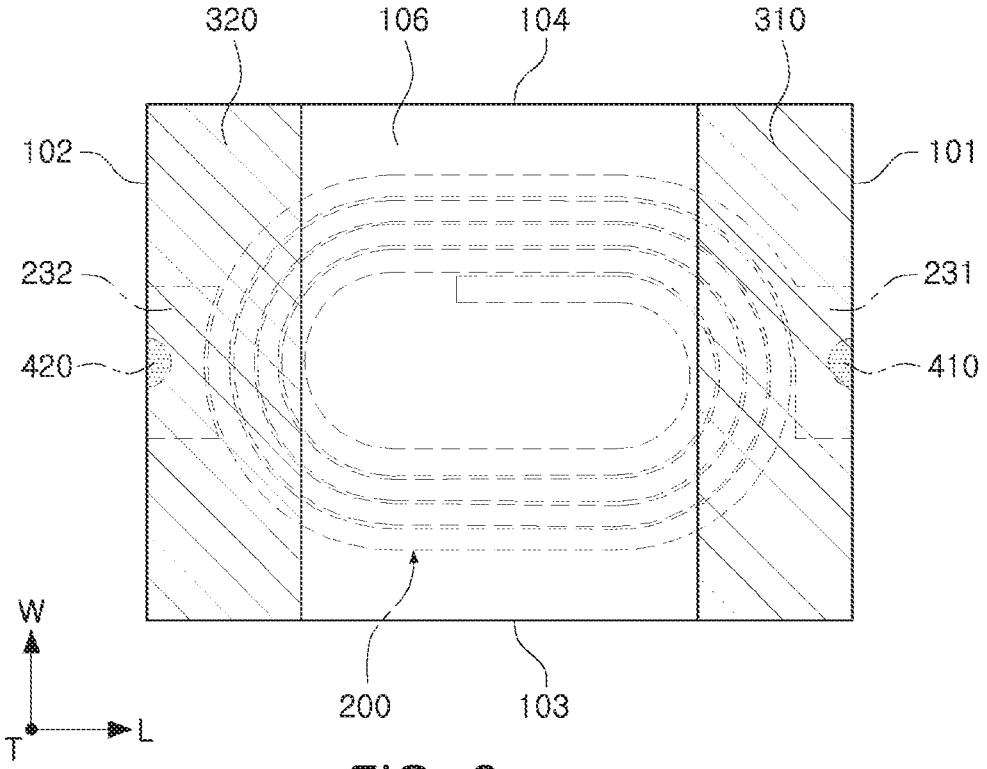
FIG. 3 is a diagram illustrating a coil component viewed from a lower portion thereof according to an example embodiment of the present disclosure.
Figure 4:
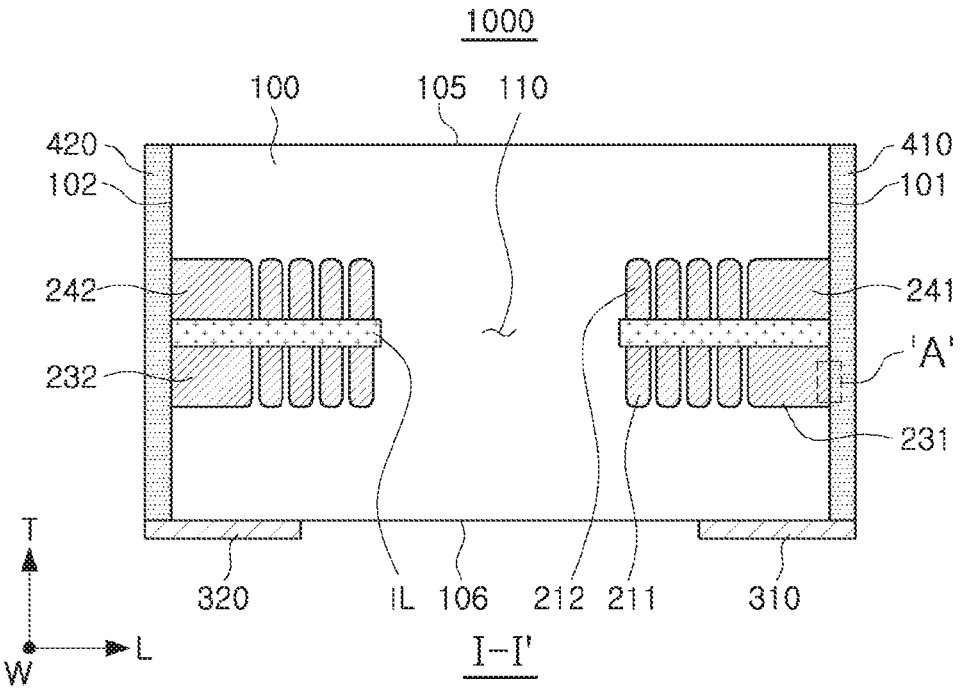
FIG. 4 is a cross-sectional diagram along line I-I' in FIG. 1.
Figure 5:
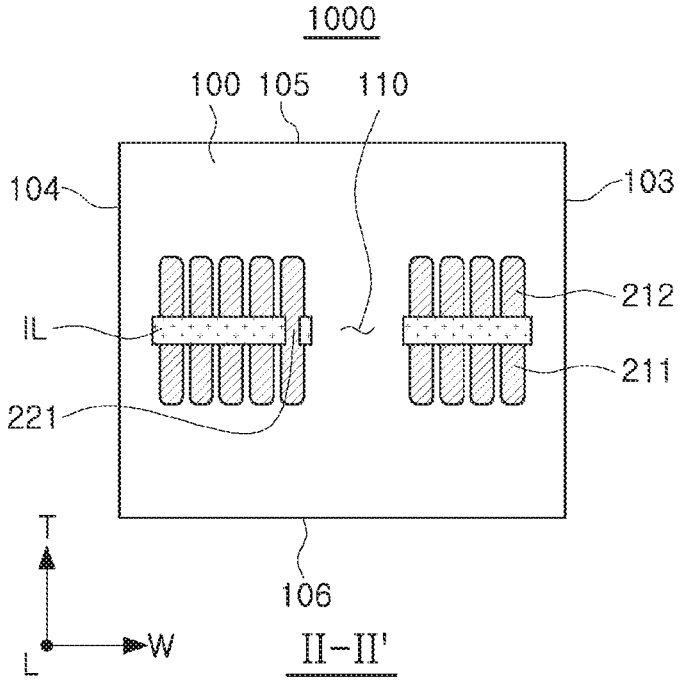
FIG. 5 is a cross-sectional diagram along line II-II' in FIG. 1.
Figure 6:
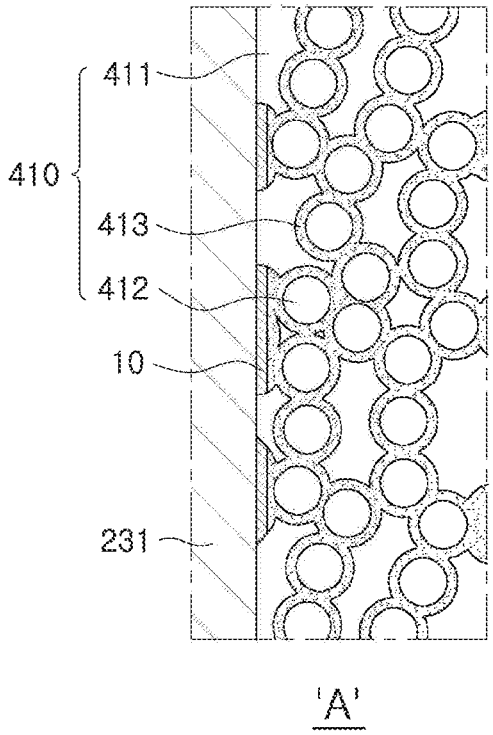
FIG. 6 is an enlarged diagram illustrating portion A illustrated in FIG. 4.

FIG. 1 is a perspective diagram illustrating a coil component according to an example embodiment. FIG. 2 is a diagram illustrating a coil component viewed from an upper portion thereof according to an example embodiment. FIG. 3 is a diagram illustrating a coil component viewed from a lower portion thereof according to an example embodiment. FIG. 4 is a cross-sectional diagram along line I-I' in FIG. 1. FIG. 5 is a cross-sectional diagram along line II-II' in FIG. 1. FIG. 6 is an enlarged diagram illustrating portion A illustrated in FIG. 4.

Referring to FIGS. 1 to 6, a coil component 1000 in the example embodiment may include a body 100, a support substrate IL, a coil portion 200, external electrodes 310 and 320, connection electrodes 410 and 420, and an intermetallic compound 10.

The body 100 may form an exterior of the coil component 1000 in the example embodiment, and the coil portion 200 may be buried in the body 100.

The body 100 may have a hexahedral shape.

As illustrated in FIGS. 1 to 5, the body 100 may include a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. The first to fourth surfaces 101, 102, 103, and 104 of the body 100 may connect and abut the fifth surface 105 and the sixth surface 106 of the body 100 to each other. In the description below, "two end surfaces of the body" (one end surface and the other end surface) may refer to the first surface 101 and the second surface 102, and "side surfaces of the body" (one side surface and the other side surface) may refer to the third surface 103 and the fourth surface 104 of the body. Also, "one surface and the other surface" of the body 100 may refer to the fifth surface 105 and the sixth surface 106 of the body 100.

The body 100 may be configured such that the coil component 1000 may have a length of 2.0 mm, a width of 1.2 mm, and a thickness of 0.65 mm, but an example embodiment thereof is not limited thereto.

The body 100 may include a magnetic material and an insulating resin. For example, the body 100 may be formed by layering one or more magnetic composite sheets including an insulating resin and a magnetic material dispersed in an insulating resin. Alternatively, the body 100 may have a structure different from the structure in which a magnetic material is dispersed in an insulating resin. For example, the body 100 may be formed of a magnetic material such as ferrite.

The magnetic material may be ferrite or a magnetic metal powder.

The ferrite powder may include, for example, one or more materials of a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as a Y ferrite, and a Li ferrite.

The magnetic metal powder may include one or more selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more of a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an exemplary embodiment of the magnetic metal powder is not limited thereto.

Each particle of the ferrite and the magnetic metal powder may have an average diameter of 0.1 μm to 30 μm, but an example of the average diameter is not limited thereto.

The body 100 may include two or more types of magnetic materials dispersed in an insulating resin. The notion that types of the magnetic materials are different may indicate that one of an average diameter, a composition, crystallinity, and a form of a magnetic material dispersed in an insulating resin is different from those of the other magnetic material(s).

The insulating resin may include one of an epoxy, a polyimide, a liquid crystal polymer, or mixture thereof, but the example of the resin is not limited thereto.

The body 100 may include a core 110 penetrating the coil portion 200. The core 110 may be formed by filling a through-hole of the coil portion 200 with a magnetic composite sheet, but an example embodiment thereof is not limited thereto.

The support substrate IL may be buried in the body 100. The support substrate IL may support the coil portion 200.

The support substrate IL may be formed of an insulating material including a thermosetting insulating resin such as an epoxy resin, a thermoplastic insulating resin such as a polyimide, or a photosensitive insulating resin, or may be formed of an insulating material in which a reinforcing material such as glass fiber or an inorganic filler is impregnated in the above-described insulating resin. For example, the support substrate IL may be formed of an insulating material such as copper clad laminate (CCL), an unclad CCL, prepreg, Ajinomoto Build-up Film (ABF), FR-4, a bismaleimide triazine (BT) film, a photoimageable dielectric (PID) film, and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate IL is formed of an insulating material including a reinforcing material, the support substrate IL may provide improved stiffness. When the support substrate IL is formed of an insulating material which does not include glass fiber, it may be desirable to increase a volume of the coil portion 200 in the body 100 of the same size. When the support substrate IL is formed of an insulating material including a photosensitive insulating resin, the number of processes for forming the coil portion 200 may decrease such that production costs may be reduced, and a fine via may be formed.

The coil portion 200 may be disposed on the support substrate IL and may be buried in the body 100. The coil portion 200 may exhibit properties of a coil component. For example, when the coil component 1000 is used as a power inductor, the coil portion 200 may store an electrical field as a magnetic field and may maintain an output voltage, thereby stabilizing power of an electronic device.

The coil portion 200 may include coil patterns 211 and 212, lead-out patterns 231 and 232, auxiliary lead-out patterns 241 and 242, and a via 221.

For example, as illustrated in FIGS. 4 and 5, the first coil pattern 211, the first lead-out pattern 231, and the second lead-out pattern 232 may be disposed on a lower surface of the support substrate IL facing the sixth surface 106 of the body 100, and the second coil pattern 212, the first auxiliary lead-out pattern 241, and the second auxiliary lead-out pattern 242 may be disposed on an upper surface of the support substrate IL opposing the lower surface of the support substrate IL.

Referring to FIGS. 2 to 5, the first coil pattern 211 may be in contact with (e.g., direct contact with) and connected to the first lead-out pattern 231 on the lower surface of the support substrate IL, and each of the first coil pattern 211 and the first lead-out pattern 231 may be spaced apart from the second lead-out pattern 232. Also, the second coil pattern 212 may be in contact with (e.g., direct contact with) and connected to the second auxiliary lead-out pattern 242 on the upper surface of the support substrate IL, and each of the second coil pattern 212 and the second auxiliary lead-out pattern 242 may be spaced apart from the first auxiliary lead-out pattern 241. The via 221 may penetrate the support substrate IL and may be in contact with an internal end portion of each of the first coil pattern 211 and the second coil pattern 212. Accordingly, the overall coil portion 200 may function as a single coil.

Each of the first coil pattern 211 and the second coil pattern 212 may have a planar spiral shape forming at least one turn with reference to the core 110 of the body 100 as a shaft. As an example, the first coil pattern 211 may format least one turn with reference to the core 110 as a shaft on the lower surface of the support substrate IL.

The lead-out patterns 231 and 232 and the auxiliary lead-out patterns 241 and 242 may be exposed to respective end surfaces of the two end surfaces of the body 100. The first lead-out pattern 231 and the first auxiliary lead-out pattern 241 may be exposed to the first surface 101 of the body 100, and the second lead-out pattern 232 and the second auxiliary lead-out pattern 242 may be exposed to the second surface 102 of the body 100.

At least one of the coil patterns 211 and 212, the via 221, the lead-out patterns 231 and 232, and the auxiliary lead-out patterns 241 and 242 may include one or more conductive layers.

As an example, when the second coil pattern 212, the auxiliary lead-out patterns 241 and 242, and the via 221 are formed on the other surface of the support substrate IL by a plating process, each of the second coil pattern 212, the auxiliary lead-out patterns 241 and 242, and the via 221 may include a seed layer and an electrolytic plating layer. The electrolytic plating layer may have a single layer structure or a multilayer structure. The electrolytic plating layer having a multilayer structure may be formed in conformal film structure in which an electroplating layer is covered by another electroplating layer, or a structure in which an electroplating layer is only layered on one surface of one of the electroplating layers. A seed layer of the second coil pattern 212, a seed layer of the auxiliary lead-out patterns 241 and 242, and a seed layer of the via 221 may be integrated with one another such that a boundary may not be formed between or among the elements, but an example embodiment thereof is not limited thereto. An electroplating layer of the second coil pattern 212, an electroplating layer of the auxiliary lead-out patterns 241 and 242 and an electroplating layer of the via 221 may be integrated with one another such that a boundary may not be formed among the elements, but an example embodiment thereof is not limited thereto.

The coil patterns 211 and 212, the lead-out patterns 231 and 232, and the auxiliary lead-out patterns 241 and 242 may be configured to protrude from the lower surface and the upper surface of the support substrate IL, respectively. As another example, the first coil pattern 211 and the lead-out patterns 231 and 232 may protrude on the lower surface of the support substrate IL, and the second coil pattern 212 and the auxiliary lead-out patterns 241 and 242 may be buried in the upper surface of the support substrate IL such that an upper surface of each of the second coil pattern 212 and the auxiliary lead-out patterns 241 and 242 may be exposed through the upper surface of the support substrate IL. In this case, a recessed portion may be formed on the upper surface of each of the second coil pattern 212 and/or the auxiliary lead-out patterns 241 and 242 such that the upper surface of each of the second coil pattern 212 and/or the auxiliary lead-out patterns 241 and 242 and the upper surface of the support substrate IL may not be disposed on the same plane.

Each of the coil patterns 211 and 212, the lead-out patterns 231 and 232, the auxiliary lead-out patterns 241 and 242, and the via 221 may be formed of a conductive material such as copper (Cu), aluminum (Al), silver (Ag), tin (Sn), gold (Au), nickel (Ni), lead (Pb), titanium (Ti), or alloys thereof, but an example of the material is not limited thereto.

Referring to FIGS. 1 to 3, as the first auxiliary lead-out pattern 241 is not relevant to electrical connection between the other elements of the coil portion 200, the first auxiliary lead-out pattern 241 may not be provided in example embodiments. In this case, a magnetic material in the body 100 may increase and occupy the position occupied by the auxiliary lead-out pattern 241 in the figures, and accordingly, component properties may improve.

The external electrodes 310 and 320 may be disposed on the sixth surface 106 of the body 100 and may be spaced apart from each other.

Each of the external electrodes 310 and 320 may be configured as a single layer, or may include a plurality of layers. As an example, the first external electrode 310 may include a first layer including copper (Cu), a second layer disposed on the first layer and including nickel (Ni), and a third layer disposed on the second layer and including tin (Sn).

The connection electrodes 410 and 420 may penetrate the body 100 in a thickness direction T and may connect the first and second external electrodes 310 and 320 to the first and second lead-out patterns 231 and 232. Accordingly, in the example embodiment, the first and second external electrodes 310 and 320 may be connected to the first and second lead-out patterns 231 and 232 through the connection electrodes 410 and 420 disposed in the body 100, rather than connecting the first and second external electrodes 310 and 320 to the first and second lead-out patterns 231 and 232 through a surface of the body 100.

For example, the first connection electrode 410 may penetrate the first surface 101 of the body 100 in the thickness direction T and may penetrate the first lead-out pattern 231. As the first connection electrode 410 penetrates the first surface 101 of the body 100 in the thickness direction T, the first connection electrode 410 may be in contact with and connected to the first external electrode 310 disposed on the sixth surface 106 of the body 100. The second connection electrode 420 may penetrate the second surface 102 of the body 100 in the thickness direction T and may penetrate the second lead-out pattern 232. As the second connection electrode 420 penetrates the second surface 102 of the body 100 in the thickness direction T, the second connection electrode 420 may be in contact with and connected to the second external electrode 320 disposed on the sixth surface 106 of the body 100. Accordingly, the connection electrodes 410 and 420 may be exposed to both the fifth and sixth surfaces 105 and 106 of the body. Also, one surface of each of the connection electrodes 410 and 420 may be exposed to the first and second surfaces 101 and 102 of the body 100, respectively. The connection electrodes 410 and 420 may penetrate the auxiliary lead-out patterns 241 and 242.

In a state of a coil bar in which magnetic composite sheets are layered to cover a plurality of coils connected to each other, a through-hole may be formed in each of lead-out patterns of each adjacent coil, the lead-out patterns connected to each other, a material for forming a connection electrode is formed in the through-hole, and the plurality of coils may be divided into individual components through a dicing process. Accordingly, the first surface 101 of the body 100, one surface of the first lead-out pattern 231 exposed to the first surface 101 of the body 100, and one surface of the first connection electrode 410 exposed to the first surface 101 of the body 100 may be disposed on the same dicing plane. Thus, in the example embodiment, differently from a general coil component in which a connection structure between a lead-out pattern and an external electrode is implemented on (e.g., outside of) a surface of a body, a connection structure between the lead-out patterns 231 and 232 and the external electrodes 310 and 320 may be implemented within the body. Accordingly, differently from a general component, in the example embodiment, a volume of the body 100 may be approximate to a volume of the component 1000. Accordingly, an effective volume of a magnetic material included in the body 100 may increase.

Referring to FIG. 6, the first connection electrode 410 may include a base resin 411, a plurality of metal particles 412 disposed in the base resin 411, and a conductive connection portion 413 surrounding the plurality of metal particles 412 and in contact with the intermetallic compound 10. In the description below, an example embodiment will be described with reference to the first connection electrode 410, and the description may also be applied to the second connection electrode 420.

In the connection electrode 410, the plurality of metal particles 412 may be dispersed in the base resin 411. In this case, as an example of forming the connection electrode 410, a paste in which metal particles are dispersed in a resin may be used, and as the applied paste may be formed through a drying and curing process, the metal particles may not be melted such that the metal particles may be present as particles. For example, the paste may include metal powder including a metal having a low melting point, lower than a curing temperature of the base resin 411 and metal powder including a metal having a high melting point higher than a melting point of metal particles having a low melting point.

The metal particles 412 may include at least one of nickel (Ni), silver (Ag), copper (Cu) coated with silver, copper (Cu) coated with tin (Sn), and copper (Cu). The metal particles 412 may be spherical-type metal particles or flake-type metal particles.

When the metal particles 412 react with all the metal particles having a low melting point, included in the conductive connection portion 413 and the intermetallic compound 10, the metal particles 412 may not be present in the connection electrode 410.

In the description below, the example embodiment in which the metal particles 412 are included in the first connection electrode 410 will be described for ease of description.

The conductive connection portion 413 may be formed as the metal powder including a metal having a low melting point is melted and cooled in a process of drying and curing the paste. Accordingly, the metal having a low melting point included in the conductive connection portion 413 may have a melting point lower than a curing temperature of the base resin 411. The metal having a low melting point included in the conductive connection portion 413 may have a melting point equal to or lower than 300° C.

The metal included in the conductive connection portion 413 may be formed of an alloy including two or more materials selected from among tin (Sn), lead (Pb), indium (In), copper (Cu), silver (Ag), and bismuth (Bi).

The conductive connection portion 413 may surround the plurality of metal particles 412 and may connect the plurality of metal particles 412 to each other. The conductive connection portion 413 may increase electrical conductivity of the connection electrode 410 and may decrease resistance of the connection electrode 410. In other words, as the metal having a low melting point included in the conductive connection portion 413 has a melting point lower than a curing temperature of the base resin 411, the metal may be melted in the drying and curing process, and as illustrated in FIG. 6, the conductive connection portion 413 may be configured to connect the plurality of metal particles 412 to each other.

The connection electrode 410 may be formed by filling the above-described through-hole with a resin paste and drying and curing the paste. When the resin paste includes silver (Ag) and tin (Sn) powder, the conductive connection portion 413 may include $Ag_3Sn$. In this case, the lead-out pattern 231 may include copper (Cu), and the intermetallic compound 10 disposed between the connection electrode 410 and the lead-out pattern 231 may include Cu—Sn.

The intermetallic compound 10 may be disposed between the first lead-out pattern 231 and the first connection electrode 410 and may be in contact with and connected to the conductive connection portion 413. The intermetallic compound 10 may improve electrical and mechanical bonding between the connection electrode 410 and the first lead-out pattern 231 such that contact resistance between the connection electrode 410 and the first lead-out pattern 231 may be reduced.

The intermetallic compound 10 may be formed as the metal powder including the metal having a low melting point reacts with a metal included in the first lead-out pattern 231 in the process of drying and curing the paste. For example, when the metal powder including the metal having a low melting point includes tin (Sn), and the lead-out pattern 231 includes copper (Cu), the intermetallic compound 10 may include copper-tin (Cu—Sn). However, an example embodiment thereof is not limited thereto, and the intermetallic compound 10 may be formed of one of silver-tin (Ag—Sn) and nickel-tin (Ni—Sn).

The intermetallic compound 10 may be provided as a plurality of the intermetallic compounds 10, and the plurality of intermetallic compounds 10 may be disposed between the connection electrode 410 and the lead-out pattern 231 and may be spaced apart from each other. In other words, the intermetallic compound 10 may be disposed between the connection electrode 410 and the lead-out pattern 231 in the form of a plurality of islands spaced apart from each other along a surface of the lead-out pattern 231 by the base resin.

The base resin 411 may include a thermosetting resin having electrical insulating properties. The thermosetting resin may be an epoxy resin, for example, but an example embodiment thereof is not limited thereto. The thermosetting resin included in the base resin 411 may be the same as the thermosetting resin included in the body 100. In this case, mechanical cohesion force between the connection electrode 410 and the body 100 may improve.

Although not illustrated in the diagram, the coil component 1000 in the example embodiment may further include an insulating film disposed between the coil portion 200 and the body 100. The insulating film may be formed by at least one or more of a vapor deposition method and a film layering method. In the case of the latter, the insulating film may be a permanent resist film, which may be formed by a plating resist remaining in a final product, the plating resist used in the process of forming the coil portion 200 on the support substrate IL by a plating process. However, an example embodiment thereof is not limited thereto.

Also, although not illustrated in the diagram, the coil component 1000 in the example embodiment may further include an external insulating layer surrounding the first to fifth surfaces 101, 102, 103, 104, and 105 of the body 100. The external insulating layer may also be formed in a region of the sixth surface 106 of the body 100 in which the external electrodes 310 and 320 are not formed.

SECOND EXAMPLE EMBODIMENT

Figure 7:
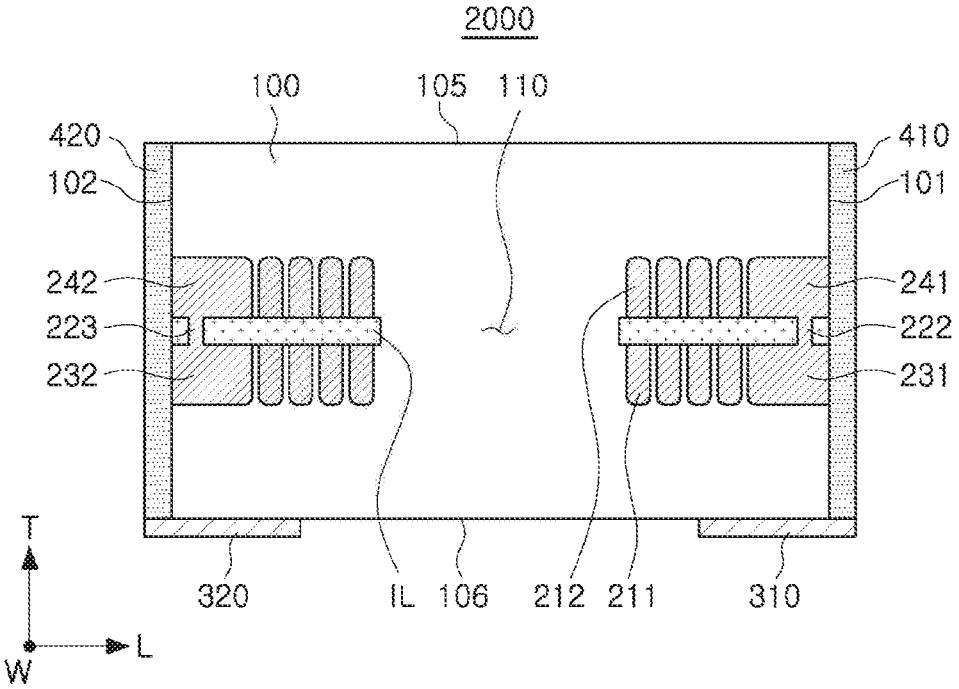
FIG. 7 is a diagram illustrating a coil component according to another example embodiment of the present disclosure, corresponding to the end surface along line I-I' in FIG. 1.

FIG. 7 is a diagram illustrating a coil component according to another example embodiment, corresponding to the cross-sectional diagram along line I-I' in FIG. 1.

Referring to FIGS. 1 to 6 and FIG. 7, in a coil component 2000 in the example embodiment, a connection relationship between the lead-out patterns 231 and 232 and the auxiliary lead-out patterns 241 and 242 may be different from that of the coil component 1000 in the aforementioned example embodiment. Accordingly, in the example embodiment, only the connection relationship between the lead-out patterns 231 and 232 and the auxiliary lead-out patterns 241 and 242 (i.e., a difference from that of the coil component 1000) will be described. The descriptions of the other elements are the same as in the aforementioned example embodiment.

The coil portion 200 in the example embodiment may further include connection vias 222 and 223 penetrating a support substrate IL to connect the lead-out patterns 231 and 232 to the auxiliary lead-out patterns 241 and 242.

The first connection via 222 may penetrate the support substrate IL and may connect the first lead-out pattern 231 to the first auxiliary lead-out pattern 241. The second connection via 223 may penetrate the support substrate IL and may connect the second lead-out pattern 232 to the second auxiliary lead-out pattern 242. The connection vias 222 and 223 may be spaced apart from the connection electrodes 410 and 420.

The connection vias 222 and 223 may be formed of a material that is the same as a material of the lead-out patterns 231 and 232 and the auxiliary lead-out patterns 241 and 242. As an example, when the lead-out patterns 231 and 232 and the auxiliary lead-out patterns 241 and 242 are formed of copper (Cu) through an electrolytic copper plating process, the connection vias 222 and 223 may also be formed of copper (Cu) through an electrolytic copper plating process. The connection vias 222 and 223 may be integrated with the lead-out patterns 231 and 232 and/or the auxiliary lead-out patterns 241 and 242, but an example embodiment thereof is not limited thereto.

In the example embodiment, as the connection vias 222 and 223 are formed of a same material as the lead-out patterns 231 and 232 and the auxiliary lead-out patterns 241 and 242, contact resistance between the lead-out patterns 231 and 232 and the auxiliary lead-out patterns 241 and 242 may be reduced.

According to the aforementioned example embodiment, properties of the component may improve by increasing an effective volume of a magnetic material.

Also, component properties may improve by reducing contact resistance between the lead-out pattern and the connection electrode.

While the exemplary embodiments have been shown and described above, it will be apparent to those skilled in the art that modifications and variations could be made without departing from the scope of the present invention as defined by the appended claims.

What is claimed is:

1. A coil component, comprising:

a body embedding a support substrate therein;

an external electrode disposed on one surface of the body;

a coil portion disposed on the support substrate, and including a lead-out pattern having one surface exposed to one end surface of the body abutting the one surface of the body;

a connection electrode penetrating the lead-out pattern, extending to the external electrode, and having one surface exposed to the one end surface of the body; and an intermetallic compound disposed between the connection electrode and the lead-out pattern, wherein the connection electrode includes a base resin, a plurality of metal particles disposed in the base resin, and a conductive connection portion surrounding the plurality of metal particles and in contact with the intermetallic compound.

2. The coil component of claim 1, wherein the conductive connection portion has a melting point lower than a curing temperature of the base resin.

3. The coil component of claim 1, wherein the intermetallic compound includes one of copper-tin, silver-tin, and nickel-tin, and wherein each of the plurality of metal particles is at least one of copper, nickel, silver, copper coated with silver, or copper coated with tin.

4. The coil component of claim 1, wherein the intermetallic compound is disposed as plurality of intermetallic compound segments each disposed between the connection electrode and the lead-out pattern and spaced apart from each other.

5. The coil component of claim 1, wherein the connection electrode extends from the one surface of the body to another surface of the body opposing the one surface of the body.

6. The coil component of claim 1, wherein the coil portion includes:

first and second coil patterns respectively disposed on one surface and another surface of the support substrate opposing each other;

the lead-out pattern serving as a first lead-out pattern disposed on the one surface of the support substrate, connected to the first coil pattern, and exposed to the one end surface of the body; and a second lead-out pattern disposed on the one surface of the support substrate, spaced apart from the first coil pattern and the first lead-out pattern, and exposed to another end surface of the body opposing the one end surface of the body, and wherein the connection electrode includes a first connection electrode penetrating the first lead-out pattern and exposed to the one end surface of the body, and a second connection electrode penetrating the second lead-out pattern and exposed to the other end surface of the body.

7. The coil component of claim 6, wherein the coil portion further includes a second auxiliary lead-out pattern disposed on the other surface of the support substrate, connected to the second coil pattern, and penetrated by the second connection electrode.

8. The coil component of claim 7, wherein the coil portion further includes a first auxiliary lead-out pattern disposed on the other surface of the support substrate, spaced apart from each of the second coil pattern and the second auxiliary lead-out pattern, and penetrated by the first connection electrode.

9. The coil component of claim 1, wherein the one surface of the lead-out pattern, the one surface of the connection electrode, and the one end surface of the body are disposed on a same plane.

10. A coil component, comprising:

a body having one surface and another surface opposing each other, and first and second end surfaces connecting the one surface and the other surface to each other and opposing each other;

a support substrate embedded in the body;

a coil portion disposed on the support substrate and including first and second lead-out patterns respectively exposed to the first and second end surfaces of the body;

first and second connection electrodes each including a base resin, a plurality of metal particles disposed in the base resin, and a conductive connection portion surrounding the plurality of metal particles, the first and second connection electrodes each extending from the one surface of the body to the other surface of the body, respectively penetrating the first and second lead-out patterns, each penetrating the support substrate, and each having one surface exposed to a respective one of the first and second end surfaces of the body; and an intermetallic compound disposed between the first connection electrode and the first lead-out pattern and between the second connection electrode and the second lead-out pattern, and in contact with and connected to the conductive connection portion of the corresponding connection electrode of the first and second connection electrodes.

11. A coil component comprising:

a body having a planar end surface; and a coil portion embedded in the body, and including a coil pattern embedded in the body and a lead-out pattern extending from the coil pattern to be exposed to the planar end surface of the body;

a connection electrode penetrating the body and the lead-out pattern, and having one surface exposed to the planar end surface of the body across a full height of the planar end surface of the body.

12. The coil component of claim 11, wherein the connection electrode is exposed to the planar end surface of the body across less than a full width, orthogonal to the height, of the planar end surface of the body, and a width of the connection electrode exposed to the planar end surface of the body is less than a width of the lead-out pattern exposed to the planar end surface of the body.

13. The coil component of claim 11, further comprising:

an external electrode disposed on one surface of the body abutting the planar end surface of the body, wherein the connection electrode contacts the external electrode at one end thereof, and the planar end surface of the body is free of the external electrode.

14. The coil component of claim 11, wherein the lead-out pattern includes at least two segments exposed to the planar end surface of the body and spaced apart from each other by the connection electrode.

15. The coil component of claim 11, further comprising:

a substrate having the coil pattern disposed on at least one surface thereof, wherein the substrate is at least partly embedded in the body and is exposed to the planar end surface of the body.

16. The coil component of claim 15, wherein the substrate includes at least two segments exposed to the planar end surface of the body and spaced apart from each other by the connection electrode.

17. The coil component of claim 15, wherein the coil pattern includes first and second coil patterns respectively disposed on first and second opposing surfaces of the substrate, the lead-out pattern is a first lead-out pattern connected to the first coil pattern and disposed on the first surface of the substrate, the coil portion further includes a second lead-out pattern connected to the second coil pattern, disposed on the second surface of the substrate, and extending from the second coil pattern to be exposed to another planar end surface of the body opposite the planar end surface, and the coil component includes a second connection electrode penetrating the body and the second lead-out pattern, and having one surface exposed to the other planar end surface of the body across a full height of the other planar end surface of the body.

18. The coil component of claim 11, further comprising an intermetallic compound disposed between the connection electrode and the lead-out pattern, wherein the connection electrode includes a base resin, a plurality of metal particles disposed in the base resin, and a conductive connection portion surrounding the plurality of metal particles and in contact with the intermetallic compound.

19. The coil component of claim 18, wherein the conductive connection portion has a melting point lower than a curing temperature of the base resin.

* * * * *